US011091346B2

(12) United States Patent
Yamamoto et al.

(10) Patent No.: US 11,091,346 B2
(45) Date of Patent: Aug. 17, 2021

(54) KNIFE-TYPE FOLDING MACHINE

(71) Applicant: Horizon International Inc., Shiga (JP)

(72) Inventors: Hiroki Yamamoto, Shiga (JP); Yoshikazu Nakamura, Shiga (JP); Shigeru Wakimoto, Shiga (JP); Hideaki Tabuchi, Shiga (JP)

(73) Assignee: HORIZON INTERNATIONAL INC., Shiga (JP)

( * ) Notice: Subject to any disclaimer, the term of this patent is extended or adjusted under 35 U.S.C. 154(b) by 154 days.

(21) Appl. No.: 16/581,919

(22) Filed: Sep. 25, 2019

(65) Prior Publication Data

US 2020/0122955 A1 Apr. 23, 2020

(30) Foreign Application Priority Data

Oct. 17, 2018 (JP) ..... JP2018-195992

(51) Int. Cl.
*B65H 37/06* (2006.01)

(52) U.S. Cl.
CPC ..... *B65H 37/06* (2013.01); *B65H 2557/63* (2013.01)

(58) Field of Classification Search
CPC ..... B65H 37/06; B65H 2557/63
See application file for complete search history.

(56) References Cited

U.S. PATENT DOCUMENTS 4,419,088 A * 12/1983 Nemec ..... B65H 45/18 493/444
5,405,127 A * 4/1995 Welborn ..... B41F 13/56 270/21.1
2002/0039956 A1 4/2002 Kitai
2010/0310340 A1* 12/2010 Suzuki ..... B65H 45/18 412/33
2012/0302415 A1 11/2012 Yamamoto

FOREIGN PATENT DOCUMENTS

| | | |
|---|---|---|
| EP | 1900669 | 3/2008 |
| JP | H03272971 | 12/1991 |
| JP | 200344418 | 12/2000 |
| JP | 2003238025 | 8/2003 |
| WO | 2011086700 | 7/2011 |

OTHER PUBLICATIONS

European Search Report in corresponding EP App. No. 19202900.7 dated Mar. 13, 2020.

* cited by examiner

*Primary Examiner* — Jennifer Bahls
(74) *Attorney, Agent, or Firm* — Kirschstein, Israel, Schiffmiller & Pieroni, P.C.

(57) ABSTRACT

A sheet supplying unit 1 supplies sheets S one by one. A knife-type folding unit 5 folds the sheet. A first sensor 28 detects the sheet entering the folding position. A second sensor 30*a*, 30*b* detects the sheet passing through the opening. A timer 31 measures a time interval from end of sheet detection by the second sensor to start of sheet detection by the first sensor. A sheet feed interval change unit 33 calculates a reduction amount of the sheet feed interval using the measured values of the timer and changes the sheet feed interval based on the reduction amount each time a predetermined number of the sheets are folded.

7 Claims, 9 Drawing Sheets

KNIFE-TYPE FOLDING MACHINE

TECHNICAL FIELD

The present invention relates to a knife-type folding machine in which a sheet is folded by a knife blade.

BACKGROUND ART

A conventional knife-type folding machine is disclosed in for example, WO 2011/086700 A1.

The knife-type folding machine disclosed in WO 2011/086700 A1 has a frame provided with a conveying path of a sheet (The technical term "sheet" means a signature as well as a sheet of paper), a conveying unit attached to the frame so as to convey the sheet along the conveying path, and a stopper attached to the frame and crossing the conveying path at a right angle in such a way that the sheet is positioned at a predetermined folding position on the conveying path by colliding with the stopper at a leading end thereof.

The conveying unit consists of a pair of a drive roller and an idle roller which are attached to the frame and extend perpendicularly to a conveying direction at upstream and downstream ends of the conveying path, a conveyor belt extended between the drive roller and the idle roller, and a motor circulating the conveyor belt. A transport surface of the conveyor belt is positioned in the conveying path.

The knife-type folding machine also has a pair of folding rollers attached to the frame and extending along the conveying path under the folding position, and a knife blade extending parallel with the pair of folding rollers and opposed to a gap of the pair of folding rollers above the pair of folding rollers.

Furthermore, the conveying path is provided with an opening through which the knife blade can pass in a vertical direction, and a slider crank mechanism is attached to the frame so as to reciprocate the knife blade in a vertical direction between a first position in which the knife blade is arranged above the folding position and a second position in which the knife blade comes close to the gap of the pair of folding rollers under the folding position.

Thus each time the sheet is positioned at the folding position, a crank of the slider crank mechanism makes a turn, and during the one turn of the crank, the knife blade fixed to one end of a rod which is connected to the crank performs a reciprocating motion in which the knife blade moves downward from the first position to the second position and moves upward from the second position to the first position. When the knife blade moves downward from the first position to the second position, the sheet passes through the opening of the conveying path while being folded in two by the knife blade and is inserted between the pair of folding rollers, and then the sheet is folded in two by the pair of folding rollers while the knife blade moves upward from the second position to the first position.

In this case, if the next sheet is supplied to the folding position while there is a previous sheet which has been proceeded on the folding position, a sheet jam occurs due to collision between sheets and it is, therefore, necessary to adequately set a sheet feed interval (time interval) before operation of the knife-type folding machine.

In the prior art, workers manually conduct this setting of the sheet feed interval based on their experience and intuition while visually checking the occurrence of the sheet jam during a test run of the knife-type folding machine.

However, it is not easy to visually check the occurrence of the sheet jam because of high speed operation of the knife-type folding machine, and accordingly the setting of the sheet feed interval takes time and effort. In addition, the sheet feed interval set in this way still has enough leeway to be shortened.

These have been a factor in reducing productivity.

Moreover, some of conventional knife-type folding machines capable of automatically calculating and setting a sheet feed interval based on default values of parameters such as a size of a sheet, a conveying speed of a sheet, a time required for a reciprocal motion of a knife blade etc.

However, although the sheet feed interval automatically set by the knife-type folding machine is a theoretical value, that is a numerical value in which sheet characteristics such as friction and stiffness etc. are not taken into account, a time interval (delay time) from positioning of a sheet at a folding position to start of lowering of a knife blade and a time interval of a reciprocal motion of the knife blade and so on vary from sheet to sheet due to the sheet characteristics.

Consequently, when the knife-type folding machine is operated with the sheet feed interval automatically set by the knife-type folding machine, the collision between sheets occurs.

Therefore, the sheet feed interval automatically set by the knife-type folding machine is normally corrected by adding the sheet feed interval automatically set to 10-20 percent thereof.

That is to say, also in this case, the set sheet feed interval still has enough leeway to be shortened, which contributes to productivity decline.

SUMMARY OF THE INVENTION

Problems to be Solved by the Invention

It is, therefore, an object of the present invention to provide a knife-type folding machine capable of minimize a sheet feed interval by easy operation.

Means for Solving the Problems

In order to achieve this object, the present invention provides a knife-type folding machine comprising: a sheet supplying unit supplying sheets one by one at a predetermined sheet feed interval; a conveying unit conveying the sheet received from the sheet supplying unit along a conveying path; a stopper crossing the conveying path at a right angle, the sheet being positioned at a predetermined folding position on the conveying path by colliding with the stopper at a leading end thereof; and a knife-type folding unit folding the sheet positioned at the folding position in a conveying direction, wherein the knife-type folding unit includes a pair of folding rollers arranged in place under the conveying path and extending along the conveying direction, and a knife blade extending parallel with the pair of folding rollers and opposed to a gap of the pair of folding rollers above the pair of folding rollers, the conveying path being provided with an opening through which the knife blade can pass in a vertical direction, the knife-type folding unit further including a knife blade drive mechanism reciprocating the knife blade in a vertical direction between a first position in which the knife blade is arranged above the conveying path and a second position in which the knife blade comes close to the gap of the pair of folding rollers under the conveying path, wherein, each time the sheet is positioned at the folding position, the knife blade reciprocates in a manner such that the knife blade moves downward from the first position to the second position and moves upward from the second position to the first position, wherein, when the knife blade moves downward from the first position to the second position, the sheet is inserted between the pair of folding rollers through the opening of the conveying path while being folded in two by the knife blade, and then the sheet is folded by the pair of folding rollers when the knife blade moves upward from the second position to the first position, characterized by a first sensor arranged in front of the folding position to detect the sheet entering the folding position, a second sensor arranged on one side or both sides of the opening to detect the sheet passing through the opening, a first timer measuring a time interval from end of detection of the sheet by the second sensor to start of detection of the next sheet by the first sensor, a memory sequentially storing a measured value of the first timer, and a sheet feed interval change unit performing a predetermined operation by use of a predetermined number of the measured values of the first timer so as to calculate a reduction amount of the sheet feed interval and changing the sheet feed interval based on the reduction amount each time the number of folded sheets reaches the predetermined number, wherein the sheet supplying unit supplies the sheets one by one at a changed sheet feed interval each time the sheet feed interval is changed.

According to a preferred embodiment of the present invention, the knife-type folding machine further comprises a second timer measuring a time interval from start of detection of the sheet by the first sensor to end of detection of the same sheet by the second sensor, wherein the reduction amount is the reduction amount plus a correction amount, and the correction amount is a predetermined fixed value until the number of folded sheets exceeds a predetermined threshold, and when the number of folded sheets reaches the threshold, the correction amount is a difference between maximum and minimum values of the number corresponding to the threshold of measured values of the second timer, and after the number of folded sheets exceeds the threshold, the correction amount is calculated each time the number of folded sheets reaches the threshold, the correction amount being a difference between maximum and minimum values of measured values of the number corresponding to the threshold of measured values of the second timer.

According to another preferred embodiment of the present invention, the conveying unit includes a pair of drive and idle rollers which are arranged at upstream and downstream ends of the conveying path and extend at a right angle to the conveying direction, and a plurality of conveyor belts extended between the pair of drive and idle rollers, conveying surfaces of the plurality of conveyor belts forming the conveying path, the conveying unit further including a roller drive mechanism rotating the drive roller.

According to further preferred embodiment of the present invention, the knife-type folding machine further comprises an anti-bounce roller unit arranged at an upstream end of the folding position to prevent bounce of the sheet from the stopper, wherein the anti-bounce roller unit includes a roller support arranged above the folding position, at least one slide guide extending in the conveying direction above the conveying path, the roller support being slidably attached to the at least one slide guide, a support drive mechanism sliding the roller support back and forth, and at least one roller attached to the roller support so as to rotate around a horizontal axis extending at a right angle to the conveying direction while being pressed against the plurality of conveyor belts of the conveying unit, the sheet entering the folding position while passing through the at least one roller and the plurality of conveyor belts, an outer surface of the at least one roller coming into contact with a tail end of the sheet when the sheet collides with the stopper, wherein the first sensor is a reflective optical sensor attached to the roller support, the reflective optical sensor being directed to the conveying path.

According to further preferred embodiment of the present invention, the knife-type folding machine further comprises a pair of guide plates extending in the conveying direction on both sides of the opening above the conveying path, the sheet being conveyed to the folding position while passing through a gap between the conveying path and lower ends of the guide plates, wherein the second sensor is a transmission type optical sensor composed of a light emitting element and a light receiving element, the light emitting element and the light receiving element being attached to inner sides of the pair of guide plates in a manner such that the light emitting element and the light receiving element face each other.

According to further preferred embodiment of the present invention, the second sensor is a transmission type optical sensor composed of a light emitting element and a light receiving element, the light emitting element and the light receiving element being attached to the roller support of the anti-bounce roller unit in a manner such that the light emitting element and the light receiving element face each other across the opening.

According to further preferred embodiment of the present invention, the second sensor is a transmission type optical sensor composed of a light emitting element and a light receiving element, the light emitting element and the light receiving element being attached to the stopper in a manner such that the light emitting element and the light receiving element face each other across the opening.

Effect of the Invention

According to the present invention, during operation of the knife-type folding machine, a part of a set value of sheet feed interval, which can be shortened, is measured, that is, a time interval from a time when a previous sheet disappears from the folding position (the conveying path) to a time when the next sheet starts entering the folding position is measured and the measured value is recorded sequentially. Then each time the number of folded sheets reaches the predetermined number, a reduction amount of the sheet feed interval is calculated by use of the corresponding number of the measured values and the sheet feed interval is changed based on the reduction amount.

Thereby it is possible to minimize the sheet feed interval by shortening the sheet feed interval step by step while considering variation of a delay time and a time interval of a reciprocal motion of the knife blade etc., and consequently productivity can be dramatically improved.

BEST MODE FOR CARRYING OUT THE INVENTION

A preferred embodiment of the present invention will be explained below with reference to accompanying drawings.

Figure 1:
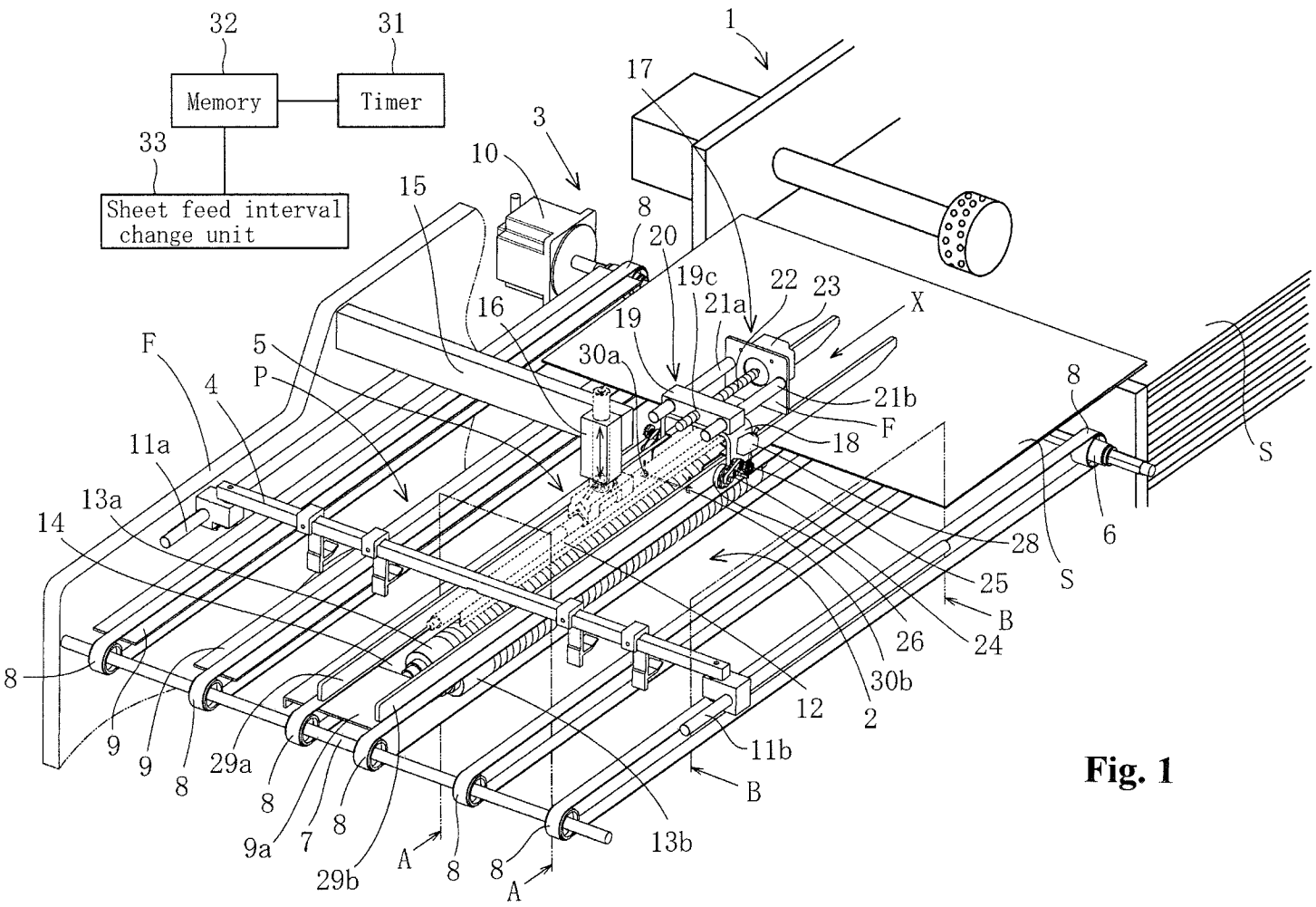
FIG. 1 is a perspective view of a knife-type folding machine according to an embodiment of the present invention, in which a sheet is about to enter a folding position.
Figure 2A:
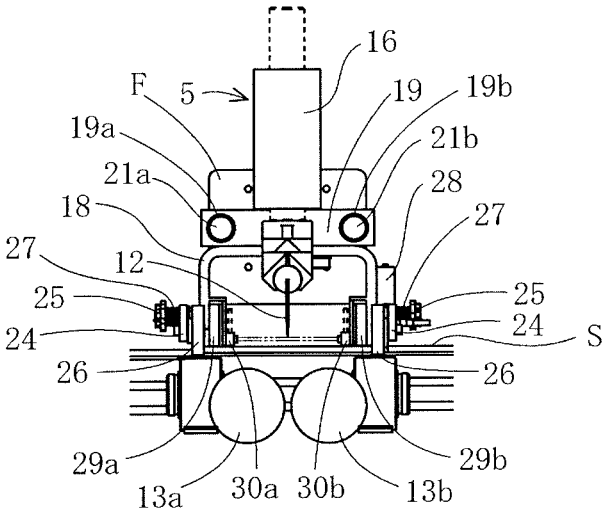
FIG. 2A is a sectional view along an A-A line in FIG. 1.
Figure 2B:
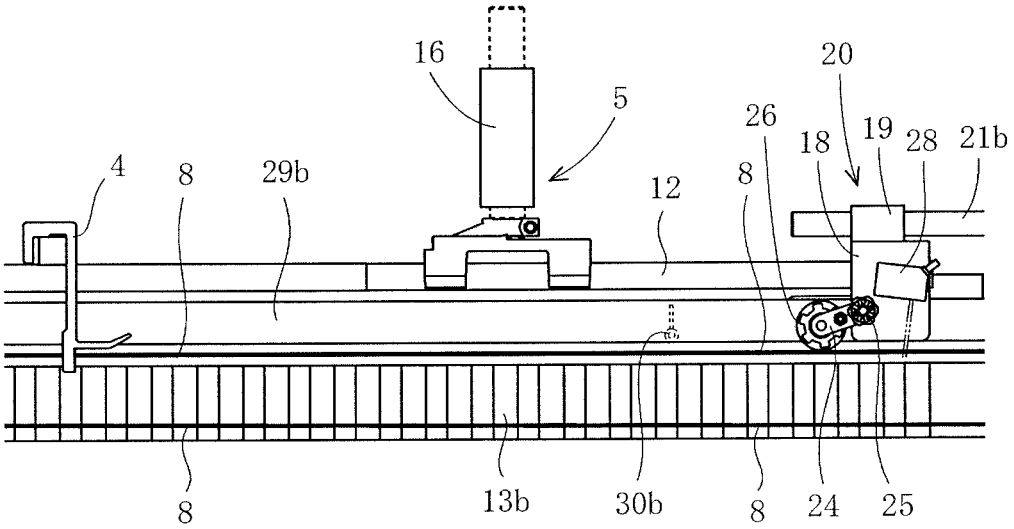
FIG. 2B is a sectional view along a B-B line in FIG. 1.
Figure 3:
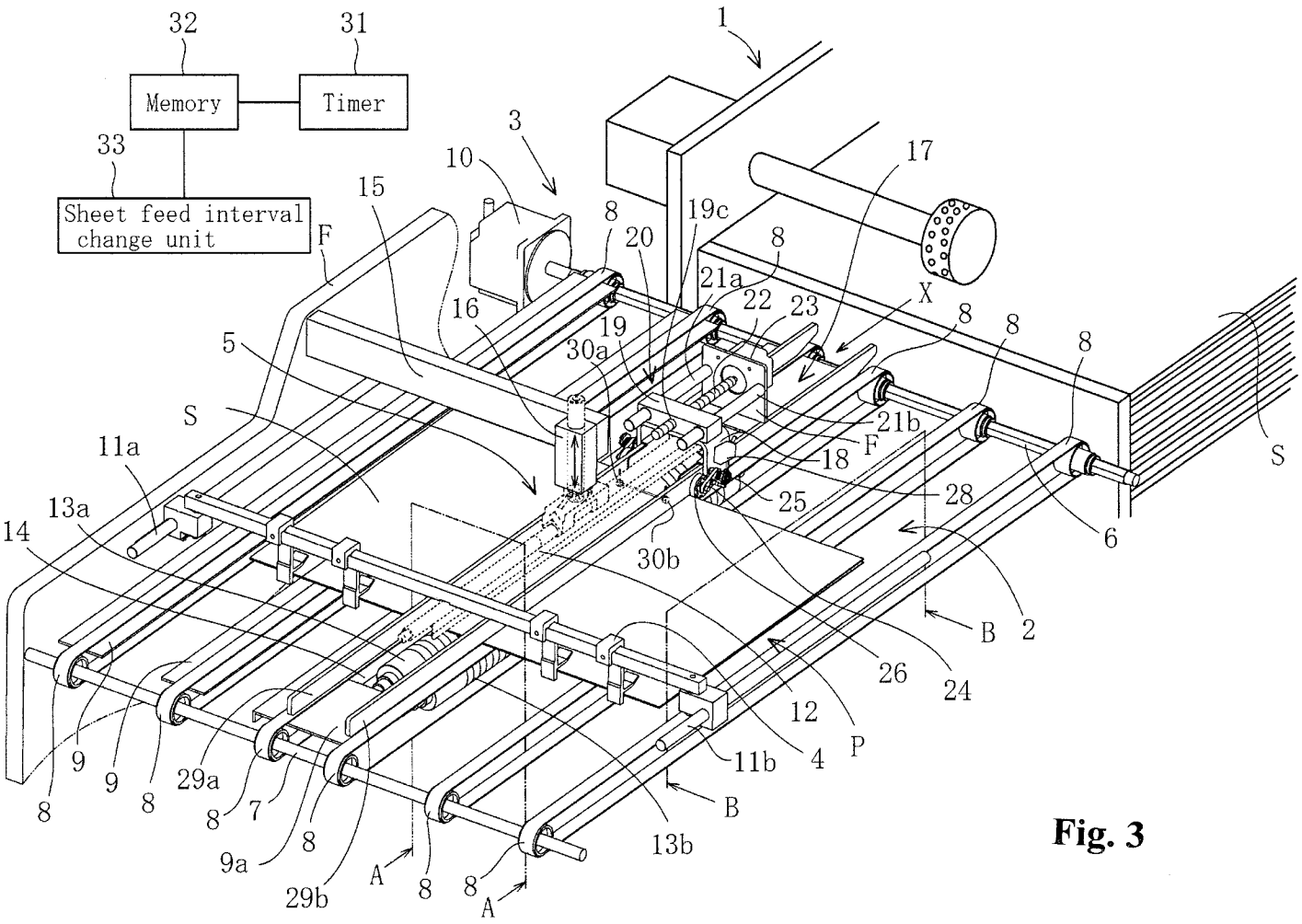
FIG. 3 is a perspective view of the knife-type folding machine shown in FIG. 1, in which the sheet is positioned on a folding position.
Figure 4A:
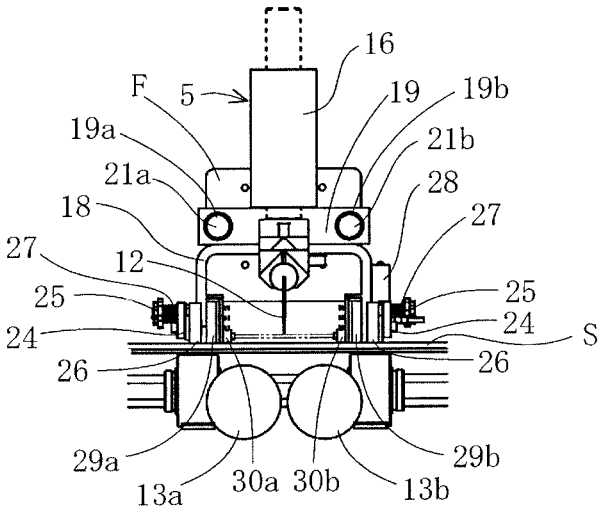
FIG. 4A is a sectional view along an A-A line in FIG. 3.
Figure 4B:
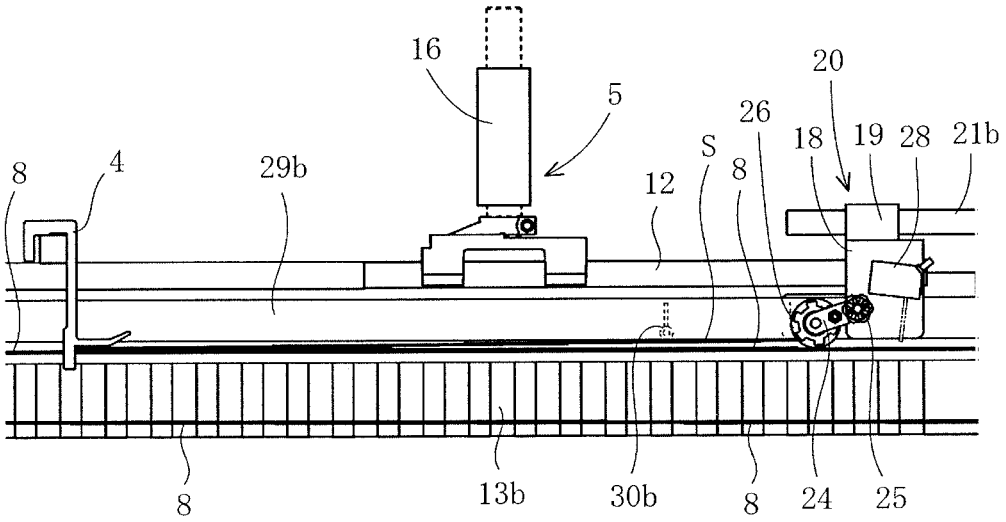
FIG. 4B is a sectional view along a B-B line in FIG. 3.

FIG. 1 is a perspective view of a knife-type folding machine according to an embodiment of the present invention, in which a sheet is about to enter a folding position. FIG. 2A is a sectional view along an A-A line in FIG. 1, and FIG. 2B is a sectional view along a B-B line in FIG. 1. FIG. 3 is a perspective view of the knife-type folding machine shown in FIG. 1, in which the sheet is positioned on a folding position. FIG. 4A is a sectional view along an A-A line in FIG. 3, and FIG. 4B is a sectional view along a B-B line in FIG. 3.

Figure 5:
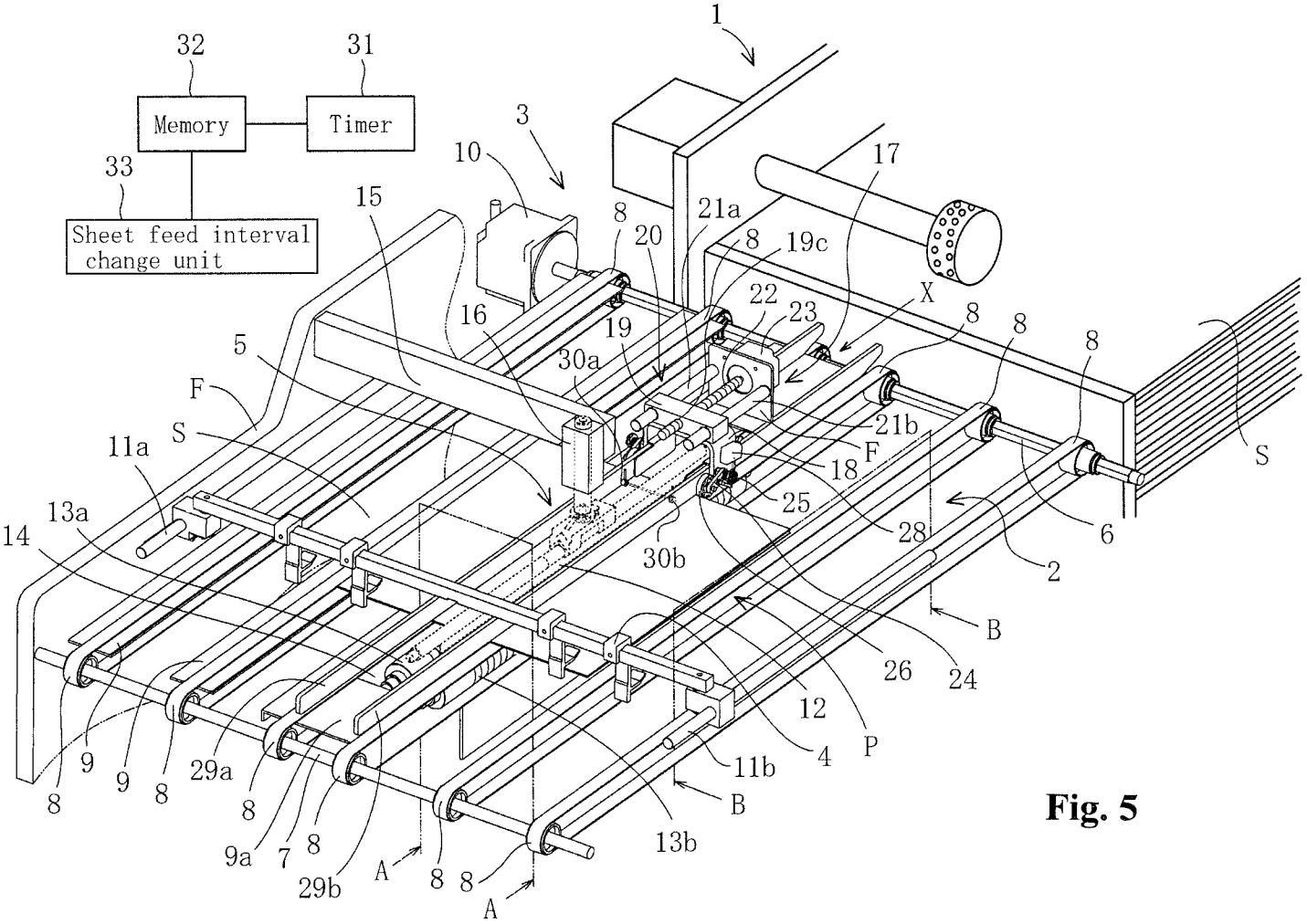
FIG. 5 is a perspective view of the knife-type folding machine shown in FIG. 1, in which a knife blade is in the lowest position (second position).
Figure 6A:
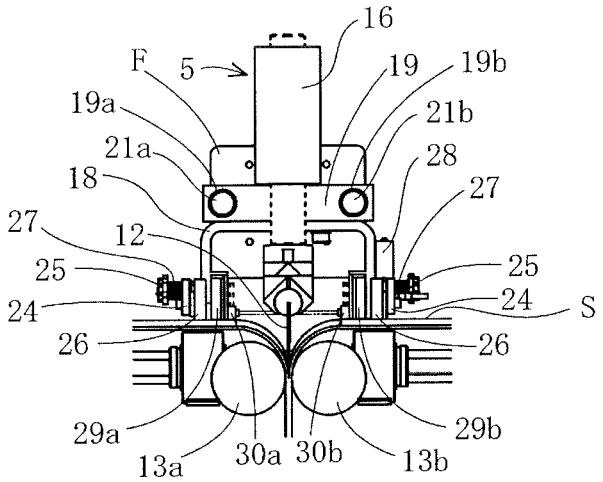
FIG. 6A is a sectional view along an A-A line in FIG. 3.
Figure 6B:
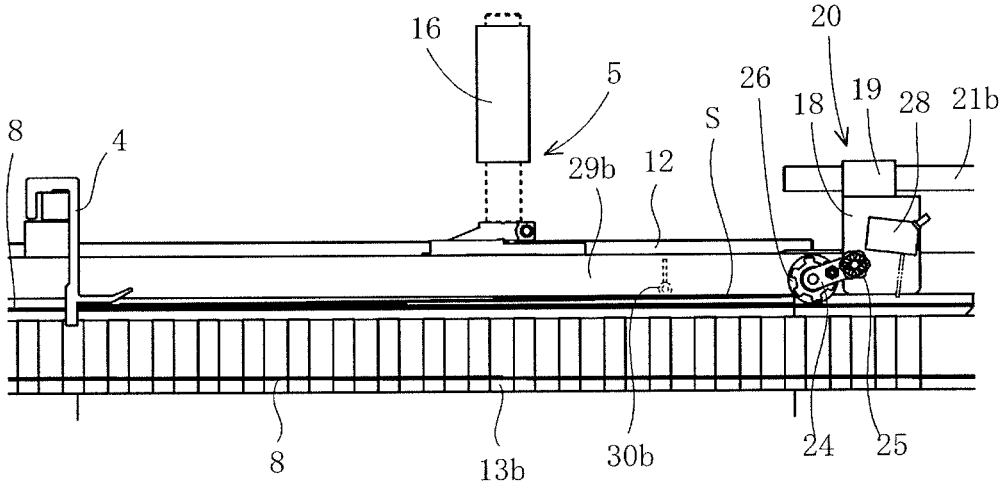
FIG. 6B is a sectional view along a B-B line in FIG. 3.
Figure 7:
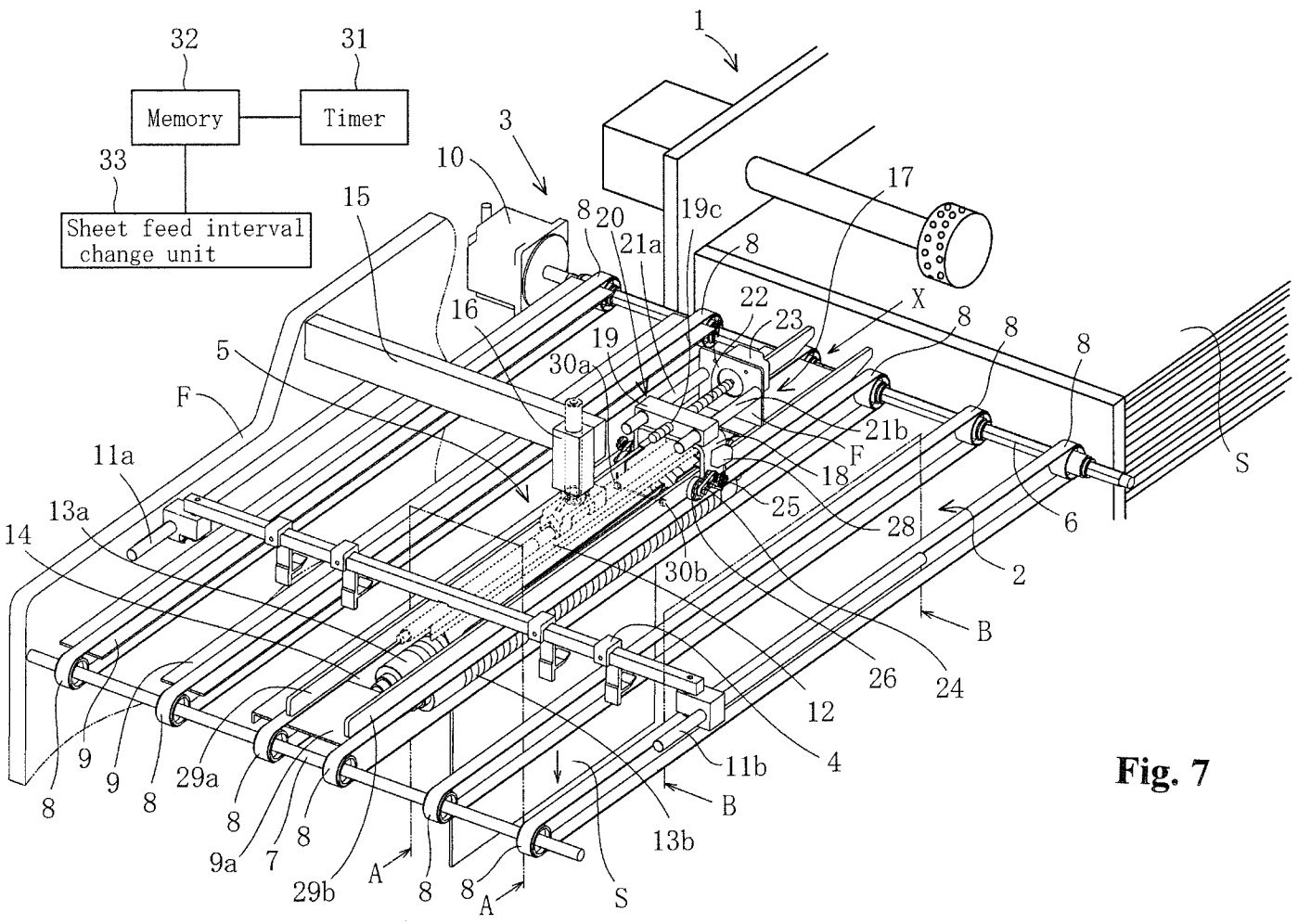
FIG. 7 is a perspective view of the knife-type folding machine shown in FIG. 1, in which the knife blade is in the highest position (first position) and the sheet is folded by a pair of folding rollers.
Figure 8A:
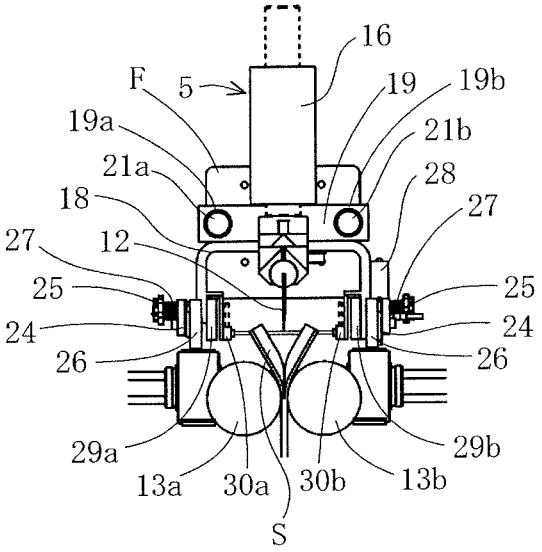
FIG. 8A is a sectional view along an A-A line in FIG. 7.
Figure 8B:
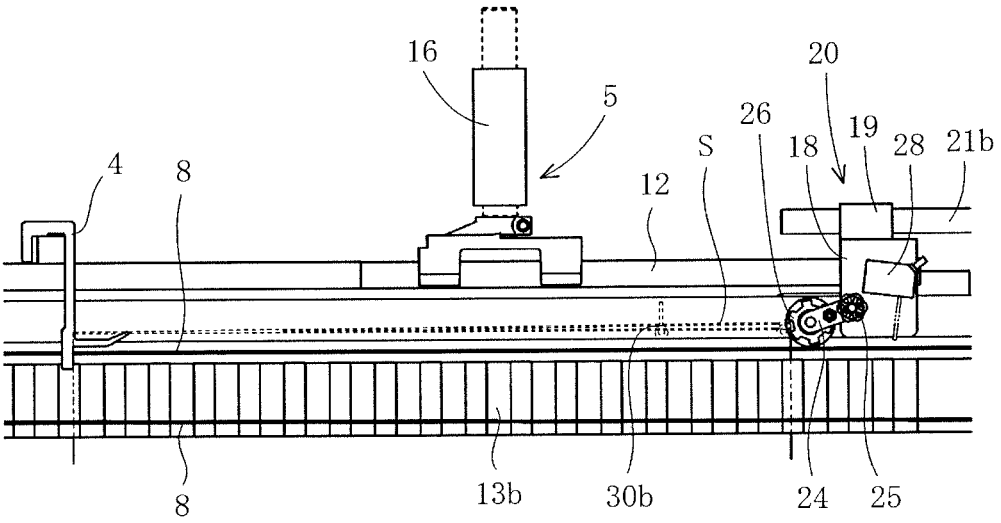
FIG. 8B is a sectional view along a B-B line in FIG. 7.
Figure 9:
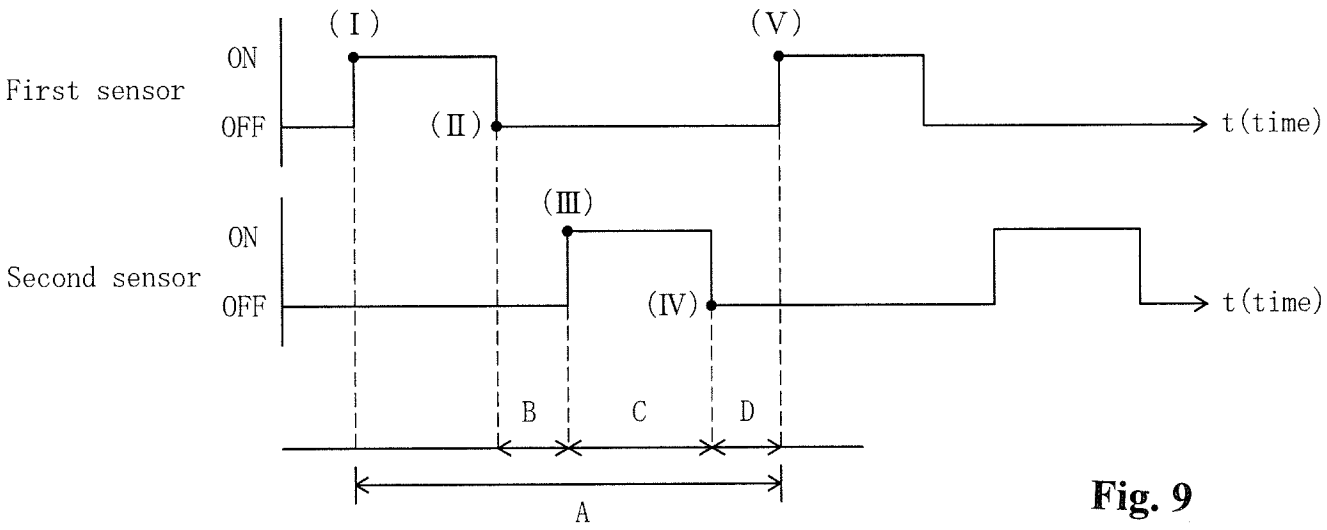
FIG. 9 is a graph showing operation timing of first and second sensors during operation of the knife-type folding machine shown in FIG. 1.

FIG. 5 is a perspective view of the knife-type folding machine shown in FIG. 1, in which a knife blade is in the lowest position (second position). FIG. 6A is a sectional view along an A-A line in FIG. 3, and FIG. 6B is a sectional view along a B-B line in FIG. 3. FIG. 7 is a perspective view of the knife-type folding machine shown in FIG. 1, in which the knife blade is in the highest position (first position) and the sheet is folded by a pair of folding rollers. FIG. 8A is a sectional view along an A-A line in FIG. 7, and FIG. 8B is a sectional view along a B-B line in FIG. 7. FIG. 9 is a graph showing operation timing of first and second sensors during operation of the knife-type folding machine shown in FIG. 1.

Referring to FIGS. 1 through 8, a knife-type folding machine according to the present invention comprises a sheet supplying unit 1 supplying sheets S one by one at a predetermined sheet feed interval, a conveying unit 3 conveying the sheet S received from the sheet supplying unit 1 along a conveying path 2, and a stopper 4 crossing the conveying path 2 at a right angle. The sheet S is positioned at a predetermined folding position P on the conveying path 2 by colliding with the stopper 4 at a leading end thereof. The knife-type folding machine further comprises a knife-type folding unit 5 folding the sheet S positioned at the folding position P in a conveying direction (indicated by an arrow X).

In this embodiment, the sheet supplying unit 1 is a well-known sheet supplying unit provided with a rotating horizontal suction roller so as to discharge sheets S one by one.

The conveying unit 3 has a pair of drive and idle rollers 6 and 7 attached to a frame F at upstream and down stream ends of the conveying path 2 and extending at a right angle to the conveying direction (arrow X), and a plurality of conveyor belts 8 extended between the drive and idle rollers 6 and 7. Conveying surfaces of the conveyor belts 8 form the conveying path 2.

A plurality of elongate support plates 9 and 9*a* (only some of the support plates are shown in the drawings) are attached on the frame F under the conveyor belts 8 so as to support the underside of the conveying surfaces of the conveyor belts 8 and extended along the conveying path 2.

The conveying unit 3 further has a motor (roller drive mechanism) 10 attached to the frame F so as to rotate the drive roller 6.

During operation of the knife-type folding machine, the drive roller 6 is rotated by the motor 10 at a constant speed at all times and thereby the conveyor belts 8 are circulated, so that the sheet S is conveyed along the conveying path 2.

The stopper 4 slidably attached to a pair of slide guides 11*a*, 11*b* fixed to the frame F on both sides of the conveying path 2 and extended in the conveying direction (arrow X). The stopper 4 can be fixed at a desired position on the slide guides 11*a*, 11*b* and thereby, a position of the stopper 4 can be adjusted in the conveying direction (arrow X).

The knife-type folding unit 5 has a knife blade 12 and a pair of folding rollers 13*a*, 13*b* which face each other in a vertical direction across the conveying path 2. The pair of folding rollers 13*a*, 13*b* is attached to the frame F and extended in the conveying direction (arrow X) under the conveying path 2 (a central support plate 9*a*), and the knife blade 12 extends parallel with the pair of folding rollers 13*a*, 13*b* and is arranged opposite to a gap between the pair of folding rollers 13*a*, 13*b* above the pair of folding rollers 13*a*, 13*b*. The support plate 9*a* is provided with an opening 14 through which the knife blade 12 can pass in a vertical direction.

The knife-type folding unit 5 also has a knife drive mechanism 16 attached to the frame F through a support arm 15 so as to reciprocate the knife blade 12 in a vertical direction between a first position (see, FIGS. 2, 4 and 8) in which the knife blade 12 is arranged above the conveying path 2 and a second position (see, FIG. 6) in which the knife blade 12 comes close to the gap between the pair of folding rollers 13*a*, 13*b* under the conveying path 2.

Thus each time the sheet S is positioned at the folding position P, the knife blade 12 reciprocates in a manner such that the knife blade 12 returns from the first position to the first position via the second position.

During this reciprocation, when the knife blade 12 moves downward from the first position to the second position (see, FIGS. 3 through 6), the sheet S is inserted between the pair of folding rollers 13*a*, 13*b* through the opening 14 while being folded in two by the knife blade 12, and then the sheet S is folded by the pair of folding rollers 13*a*, 13*b* when the knife blade 12 moves upward from the second position to the first position (see, FIGS. 7 and 8).

In this embodiment, the knife-type folding machine further comprises an anti-bounce roller unit 17 arranged at an upstream end of the folding position P to prevent bounce of the sheet S from the stopper 4.

The anti-bounce roller unit 17 includes an inverted U-shaped bracket 18 extending across the opening 14 above the folding position P, and a roller support 20 composed of a rectangular block 19 fixed on an upper surface of the bracket 18.

The block 19 has through holes 19*a*, 19*b* extending in the conveying direction (arrow X) on both sides thereof and a screw hole 19*c* passing through the block in the conveying direction (arrow X) at the center thereof.

The anti-bounce roller unit 17 also includes a pair of slide guides 21*a*, 21*b* extending in the conveying direction (arrow X) above the conveying path 2 and inserted through the through holes 19*a*, 19*b*, and a threaded shaft 22 extending in the conveying direction (arrow X) and supported by the frame F so as to be rotatable around an axis thereof at a fixed position. The threaded shaft 22 is screwed into the screw hole 19*c* of the block 19 at one end thereof. The anti-bounce roller unit 17 further includes a motor 23 fixed to the frame F. A drive shaft of the motor 23 is connected directly to the other end of the threaded shaft 22.

The threaded shaft 22 and the motor 23 configure a support drive mechanism. A position of the roller support 20 can be adjusted in the conveying direction (arrow X) by the threaded shaft 22 being rotated by the motor 23 forward and reverse.

The bracket 18 has a pair of levers 24 at exterior surfaces of both sides thereof. Each of the levers 24 is attached to the bracket 18 by screws 25 so as to be rotatable around one end thereof. A roller 26 is attached to the other end of each of the levers 24 so as to be rotatable around a horizontal axis extending at a right angle to the conveying direction (arrow X) on the associated conveyor belt 8.

Furthermore, a torsion spring 27 is arranged between the screw 25 and the lever 24 so as to elastically bias the lever 24 in a direction that the roller 26 is pressed against the conveyor belt 8. In this case, the strength of pressure of roller 26 against the conveyor belt 8 can be adjusted by adjustment of tightening force of the screw 25.

Thus the position of the roller support 20 and the tightening force of the screws 25 are adequately adjusted and thereby, the sheet S enters the folding position P while passing through the rollers 26 and the conveyor belts 8, and an outer surface of the rollers 26 come into contact with a tail end of the sheet S when the sheet S collides with the stopper 4.

A first sensor 28 is attached to an exterior surface of one side of the bracket 18 of the roller support 20 so as to detect the sheet S entering the folding position P. In this embodiment, the first sensor 28 is a reflective optical sensor which is arranged to direct to the conveying path 2 before an upstream end of the folding position P when the position of the roller support 20 is adjusted.

This configuration that the first sensor 28 is arranged at the anti-bounce roller unit 17 makes it possible to automatically adjust the position of the first sensor 28 by only adjustment of the position of the anti-bounce roller unit 17 when a size of a sheet S to be folded is changed, and thereby the work efficiency is highly improved.

The knife-type folding machine of the present invention also comprises a pair of guide plates 29*a*, 29*b* attached to the frame F and extends in the conveying direction (arrow X) on both sides of the opening 14 above the conveying path 2. The sheet S is conveyed to the folding position P while passing through a gap between the conveying path 2 and lower ends of the guide plates 29*a*, 29*b*.

A second sensor 30*a*, 30*b* is attached to inside surfaces of the pair of guide plates 29*a*, 29*b* at the folding position P. The second sensor 30*a*, 30*b* detects the sheet S passing through the opening 14 during folding motion of the knife blade 12 and the pair of folding rollers 13*a*, 13*b*.

In this embodiment, the second sensor 30*a*, 30*b* is a pair of a transmission type optical sensor composed of a light emitting element and a light receiving element. The light emitting element and the light receiving element are attached to the pair of guide plates 29*a*, 29*b* in a manner such that the light emitted from the light emitting element to the light receiving element passes through a gap between the conveying path 2 and the lower end of the knife blade 12 arranged at the first position.

The knife-type folding machine of the present invention further comprises a first timer 31 measuring a time interval from end of detection of the sheet S by the second sensor 30*a*, 30*b* to start of detection of the next sheet S by the first sensor 28, a memory 32 sequentially storing a measured value of the first timer 31, and a sheet feed interval change unit 33 performing a predetermined operation by use of a predetermined number of the measured values of the first timer 31 so as to calculate a reduction amount of the sheet feed interval and changing the sheet feed interval based on the reduction amount each time the number of folded sheets S reaches the predetermined number.

Next, an operation of the sheet feed interval change unit 33 will be explained specifically. FIG. 9 is a graph showing operation timing of the first and second sensors 28; 30*a*, 30*b* during operation of the knife-type folding machine of the present invention.

Referring to FIG. 9, when a leading end of the sheet S which is supplied from the sheet supplying unit 1 and conveyed by the conveying unit 3 enters the folding position P, the first sensor 28 turns ON (a time (I)), and when a tail end of the sheet S enters the folding position P, the sensor 28 turns OFF (a time (II)).

Then the sheet S is positioned at the folding position P by colliding with the stopper 4, and the knife blade 12 starts moving downward from the first position to the second position (a time (III)). At this time, the second sensor 30*a*, 30*b* turns on by detecting the knife blade 12 (a time (111)). A time interval (B) from the time (II) to the time (Ill) is a delay time.

While the knife blade 12 moves downward from the first position to the second position, the sheet S is inserted between the pair of folding rollers 13*a*, 13*b* through the opening 14 while being folded in two by the knife blade 12, and then the knife blade 12 moves upward from the second position to the first position and the sheet S is folded by the pair of folding rollers 13*a*, 13*b* so that the sheet S disappears from the conveying path 2 and the second sensor 30*a*, 30*b* turns off (a time (IV)). A time interval (C) from the time (III) to the time (IV) is a time interval of folding motion of the knife blade 12.

Thereafter a leading end of the next sheet S enters the folding position P and the first sensor 28 turns on (a time (V)). A time interval (A) from the time (I) to the time (V) is a sheet feed interval, and a time interval (D) from the time (IV) to the time (V) is a part of the sheet feed interval (A) which can be shortened.

In the knife-type folding machine of the present invention, during operation of the knife-type folding machine, the time intervals (D) are sequentially measured by the first timer 31 and the measured values are recorded in the memory 32.

Each time the number of folded sheets S reaches the predetermined number, for example, 10, the sheet feed interval change unit 33 calculates the reduction amount of the sheet feed interval (A) according to a predetermined formula;

$$\text{The reduction amount} = (\text{the minimum value of the measured values})/10 \quad (1)$$

by use of the 10 measured values of the first timer 31, and changes the sheet feed interval (A) based on the reduction amount.

The sheet supplying unit 1 supplies the sheets S one by one at a changed sheet feed interval (A) each time the sheet feed interval (A) is changed by the sheet feed interval change unit 33.

According to the present invention, during operation of the knife-type folding machine, a part of the sheet feed interval (A), which can be shortened, is measured, and the measured value is recorded sequentially. Then each time the number of folded sheets reaches the predetermined number, a reduction amount of the sheet feed interval (A) is calculated by use of the corresponding number of the measured values and the sheet feed interval (A) is changed based on the reduction amount.

Thereby it is possible to minimize the sheet feed interval (A) by shortening the sheet feed interval (A) step by step while considering variation of a delay time (B) and a time interval (C) of a reciprocal motion of the knife blade 12 etc., and consequently productivity can be dramatically improved.

While a preferred embodiment of the present invention has been set forth for purposes of illustration, the foregoing description should not be deemed a limitation of the invention herein. Accordingly, various modifications, adaptations and alternatives may occur to one skilled in the art without departing from the spirit and the scope of the present invention.

For example, according to another embodiment of the present invention, the knife-type folding machine comprises a second timer as well as the first timer 31, and the second timer measures a time interval from start of detection of the sheet S by the first sensor 28 to end of detection of the same sheet S by the second sensor 30*a*, 30*b* (corresponding to a time interval from the time (I) to the time (IV) (the sheet feed interval (A) minus the time interval (D)) in FIG. 9).

Thus the sheet feed interval change unit 33 calculates the reduction amount of the sheet feed interval (A) according to, for example, a formula $$\text{The reduction amount} = (\text{the above reduction amount (the formula(1))} + \text{a correction amount } \Delta \quad (2)$$

and changes the sheet feed interval (A) based on this reduction amount.

Here, the correction amount Δ is a predetermined fixed value until the number of folded sheets exceeds a predetermined threshold, for example, 1000 and when the number of folded sheets reaches 1000, the correction amount Δ is a difference between maximum and minimum values of the corresponding 1000 measured values of the second timer, and after the number of folded sheets exceeds 1000, the correction amount Δ is calculated each time the number of folded sheets reaches 1000, the correction amount Δ being a difference between maximum and minimum values of measured values of the corresponding 1000 measured values of the second timer.

Although the first sensor 28 is attached to the anti-bounce roller unit 17 and the second sensor 30*a*, 30*b* is attached to the guide plates 29*a*, 29*b* in the above embodiment, the mounting position of the first and second sensors 28; 30*a*, 30*b* is not limited to the above embodiment.

That is to say, the first sensor 28 only needs to be attached to an appropriate position in which the first sensor 28 can be detect a sheet S entering the folding position P, and the second sensor 30*a*, 30*b* only needs to be attached to an appropriate position on both sides of the opening 14 in which the second sensor 30*a*, 30*b* can detect a sheet S passing through the opening 14.

Therefore, for example, the second sensor 30*a*, 30*b* may be attached to the anti-bounce roller unit 17 or the stopper 4 in place of the guide plates 29*a*, 29*b*.

Alternatively, the second sensor 30*a*, 30*b* may be attached to both sides of the opening 14 under the opening 14.

Although the second sensor is a transmission type optical sensor composed of a light emitting element and a light receiving element in the above embodiment, the second sensor may be a reflective optical sensor which is arranged on one side of the opening 14.

DESCRIPTION OF REFERENCE NUMERALS

1 Sheet supplying unit
2 Conveying path
3 Conveying unit
4 Stopper
5 Knife-type folding unit
6 Drive roller
7 Idle roller
8 Conveyor belt
9, 9*a* Support plate
10 Motor
11*a*, 11*b* Slide guide
12 Knife blade
13*a*, 13*b* Folding roller
14 Opening
15 Support arm
16 Knife drive mechanism
17 Anti-bounce roller unit
18 Bracket
19 Block
19*a*, 19*b* Through hole
19*c* Screw hole
20 Roller support
21*a*, 21*b* Slide guide
22 Threaded shaft
23 Motor
24 Lever
25 Screw
26 Roller
27 Torsion spring
28 First sensor
29*a*, 29*b* Guide plate
30*a*, 30*b* Second sensor
31 First timer
32 Memory
33 Sheet feed interval change unit
F Frame
P Folding position
S Sheet
X Conveying direction

The invention claimed is:

1. A knife-type folding machine comprising:

a sheet supplying unit supplying sheets one by one at a predetermined sheet feed interval;

a conveying unit conveying the sheet received from the sheet supplying unit along a conveying path;

a stopper crossing the conveying path at a right angle, the sheet being positioned at a predetermined folding position on the conveying path by colliding with the stopper at a leading end thereof; and a knife-type folding unit folding the sheet positioned at the folding position in a conveying direction, wherein the knife-type folding unit includes a pair of folding rollers arranged in place under the conveying path and extending along the conveying direction, and a knife blade extending parallel with the pair of folding rollers and opposed to a gap of the pair of folding rollers above the pair of folding rollers, the conveying path being provided with an opening through which the knife blade can pass in a vertical direction, the knife-type folding unit further including a knife blade drive mechanism reciprocating the knife blade in a vertical direction between a first position in which the knife blade is arranged above the conveying path and a second position in which the knife blade comes close to the gap of the pair of folding rollers under the conveying path, wherein, each time the sheet is positioned at the folding position, the knife blade reciprocates in a manner such that the knife blade moves downward from the first position to the second position and moves upward from the second position to the first position, wherein, when the knife blade moves downward from the first position to the second position, the sheet is inserted between the pair of folding rollers through the opening of the conveying path while being folded in two by the knife blade, and then the sheet is folded by the pair of folding rollers when the knife blade moves upward from the second position to the first position, characterized by a first sensor arranged in front of the folding position to detect the sheet entering the folding position, a second sensor arranged on one side or both sides of the opening to detect the sheet passing through the opening, a first timer measuring a time interval from end of detection of the sheet by the second sensor to start of detection of the next sheet by the first sensor, a memory sequentially storing a measured value of the first timer, and a sheet feed interval change unit performing a predetermined operation by use of a predetermined number of the measured values of the first timer so as to calculate a reduction amount of the sheet feed interval and changing the sheet feed interval based on the reduction amount each time the number of folded sheets reaches the predetermined number, wherein the sheet supplying unit supplies the sheets one by one at a changed sheet feed interval each time the sheet feed interval is changed.

2. The knife-type folding machine according to claim 1, further comprising a second timer measuring a time interval from start of detection of the sheet by the first sensor to end of detection of the same sheet by the second sensor, wherein the reduction amount is the reduction amount plus a correction amount, and the correction amount is a predetermined fixed value until the number of folded sheets exceeds a predetermined threshold, and when the number of folded sheets reaches the threshold, the correction amount is a difference between maximum and minimum values of the number corresponding to the threshold of measured values of the second timer, and after the number of folded sheets exceeds the threshold, the correction amount is calculated each time the number of folded sheets reaches the threshold, the correction amount being a difference between maximum and minimum values of measured values of the number corresponding to the threshold of measured values of the second timer.

3. The knife-type folding machine according to claim 1, wherein the conveying unit includes a pair of drive and idle rollers which are arranged at upstream and downstream ends of the conveying path and extend at a right angle to the conveying direction, and a plurality of conveyor belts extended between the pair of drive and idle rollers, conveying surfaces of the plurality of conveyor belts forming the conveying path, the conveying unit further including a roller drive mechanism rotating the drive roller.

4. The knife-type folding machine according to claim 3, further comprising an anti-bounce roller unit arranged at an upstream end of the folding position to prevent bounce of the sheet from the stopper, wherein the anti-bounce roller unit includes a roller support arranged above the folding position, at least one slide guide extending in the conveying direction above the conveying path, the roller support being slidably attached to the at least one slide guide, a support drive mechanism sliding the roller support back and forth, and at least one roller attached to the roller support so as to rotate around a horizontal axis extending at a right angle to the conveying direction while being pressed against the plurality of conveyor belts of the conveying unit, the sheet entering the folding position while passing through the at least one roller and the plurality of conveyor belts, an outer surface of the at least one roller coming into contact with a tail end of the sheet when the sheet collides with the stopper, wherein the first sensor is a reflective optical sensor attached to the roller support, the reflective optical sensor being directed to the conveying path.

5. The knife-type folding machine according to claim 4, further comprising a pair of guide plates extending in the conveying direction on both sides of the opening above the conveying path, the sheet being conveyed to the folding position while passing through a gap between the conveying path and lower ends of the guide plates, wherein the second sensor is a transmission type optical sensor composed of a light emitting element and a light receiving element, the light emitting element and the light receiving element being attached to inner sides of the pair of guide plates in a manner such that the light emitting element and the light receiving element face each other.

6. The knife-type folding machine according to claim 4, wherein the second sensor is a transmission type optical sensor composed of a light emitting element and a light receiving element, the light emitting element and the light receiving element being attached to the roller support of the anti-bounce roller unit in a manner such that the light emitting element and the light receiving element face each other across the opening.

7. The knife-type folding machine according to claim 4, wherein the second sensor is a transmission type optical sensor composed of a light emitting element and a light receiving element, the light emitting element and the light receiving element being attached to the stopper in a manner such that the light emitting element and the light receiving element face each other across the opening.

* * * * *